US006349656B1

(12) United States Patent
Mitchell

(10) Patent No.: US 6,349,656 B1
(45) Date of Patent: Feb. 26, 2002

(54) NESTABLE CONTAINMENT TRAY FOR A HAZARDOUS MATERIAL SPILL PALLET

(75) Inventor: Donald J. Mitchell, Wellsburg, WV (US)

(73) Assignee: Eagle Manufacturing Company, Wellsburg, WV (US)

( * ) Notice: Subject to any disclaimer, the term of this patent is extended or adjusted under 35 U.S.C. 154(b) by 0 days.

(21) Appl. No.: 09/862,568

(22) Filed: May 22, 2001

(51) Int. Cl.[7] ..... B65D 19/00
(52) U.S. Cl. ..... 108/57.13; 108/53.1; 108/901
(58) Field of Search ..... 108/53.1, 53.3, 108/57.13, 57.16, 57.29, 901, 51.11; 206/386, 600, 599; 248/346.02

(56) References Cited

U.S. PATENT DOCUMENTS

| | | | |
|---|---|---|---|
| 3,759,194 | A | 9/1973 | Fujii et al. |
| 4,263,855 | A | 4/1981 | Lawlor |
| 4,674,414 | A | 6/1987 | Nulle et al. |
| 4,838,178 | A | 6/1989 | Chriske et al. |
| 4,930,632 | A | 6/1990 | Eckert et al. |
| 5,020,667 | A | 6/1991 | Bush |
| 5,092,251 | A | 3/1992 | Hamaker et al. |
| 5,147,039 | A | 9/1992 | Sechler et al. |
| 5,249,699 | A | 10/1993 | Williams |
| 5,307,931 | A | 5/1994 | Gillispie et al. |
| 5,359,955 | A | 11/1994 | Grebenyuk |
| 5,392,911 | A | 2/1995 | Gillispie et al. |
| 5,562,047 | A | 10/1996 | Forney et al. |

*Primary Examiner*—Janet M. Wilkens
(74) *Attorney, Agent, or Firm*—Armstrong, Westerman, Hattori, McLeland & Naughton, LLP

(57) ABSTRACT

A containment tray for a hazardous material spill pallet for storage of hazardous material containing drums. The tray provides a raised support surface for the drums and a chamber for containing spilled or leaking material from the stored drums. Access for pallet lifting member is provided from all four directions of the pallet. The containment trays are nestable for stacking and peripheral edges are reinforced for more solid support when in use and when stacked. Multiple channels along the peripheral edge are provided for attachment of auxiliary devices such as a ramp for ease of placing and removing drums.

15 Claims, 4 Drawing Sheets

NESTABLE CONTAINMENT TRAY FOR A HAZARDOUS MATERIAL SPILL PALLET

BACKGROUND OF THE INVENTION

1. Field of the Invention

The present invention relates to pallets, for supporting hazardous material containing drums, which provide a chamber for receiving and retaining hazardous material which is spilled or leaked from the supported drums.

2. Description of the Related Art

Spill pallets or other devices for containment are required by various governmental agencies for storing materials which are considered hazardous to the environment. The materials are commonly stored in metal or plastic drums and a spill pallet must include a chamber for retaining a specified volume of material depending on the number and size of the drums being stored on the pallet. Various devices are known from a simple tub to more complex devices. An improved device, enabling easier handling of the drums, features a raised grate for supporting one or more drums with a retaining chamber beneath it; channels are provided in a lower portion of the chamber for entry of fork lift tines for ease of movement. Another feature found in various pallets is the ability to nest the pallets for stacking when a large number of pallets are stored for future use or stacked to occupy a minimum amount of space for shipping from a pallet manufacturer to a user.

The spill pallet of the present invention provides a drum support surface with an underlying containment tray and means for fork truck access to the support surface. It is configured so as to be stackable in a nested arrangement. Additional features include supports in a peripheral portion of the containment tray to provide sufficient vertical support for sizeable quantities of containment trays stacked above it, and channels provided in the peripheral portion of the containment tray for positively engaging a ramp for facilitating movement of drums from or to the pallet with use of a drum dolly or the like. The pallet is of a low profile while providing the retaining capacity required by governmental regulations.

SUMMARY OF THE INVENTION

The present invention is a containment tray for a hazardous material spill pallet for storing drums of hazardous material supported on a removable grate placed on the containment tray. A bottom wall and side walls extending therefrom form an open-top fluid-receiving chamber. Recesses in the bottom wall define open channels for entry of pallet lifting means such as fork lift tines. A grate, upon which the drums are stored, is at least partially supported by support posts which are offset from the center and extend upwardly from the bottom wall. A ledge, extending outwardly from the side walls, also supports the grate. An L-shaped flange extends upwardly then inwardly from an outer periphery of the ledge, and columns, which give strength to the L-shaped flange, are positioned at various locations along the flange.

Other specific features and contributions of the invention are described in more detail with reference being made to the accompanying drawings.

DETAILED DESCRIPTION OF THE INVENTION

Figure 1:
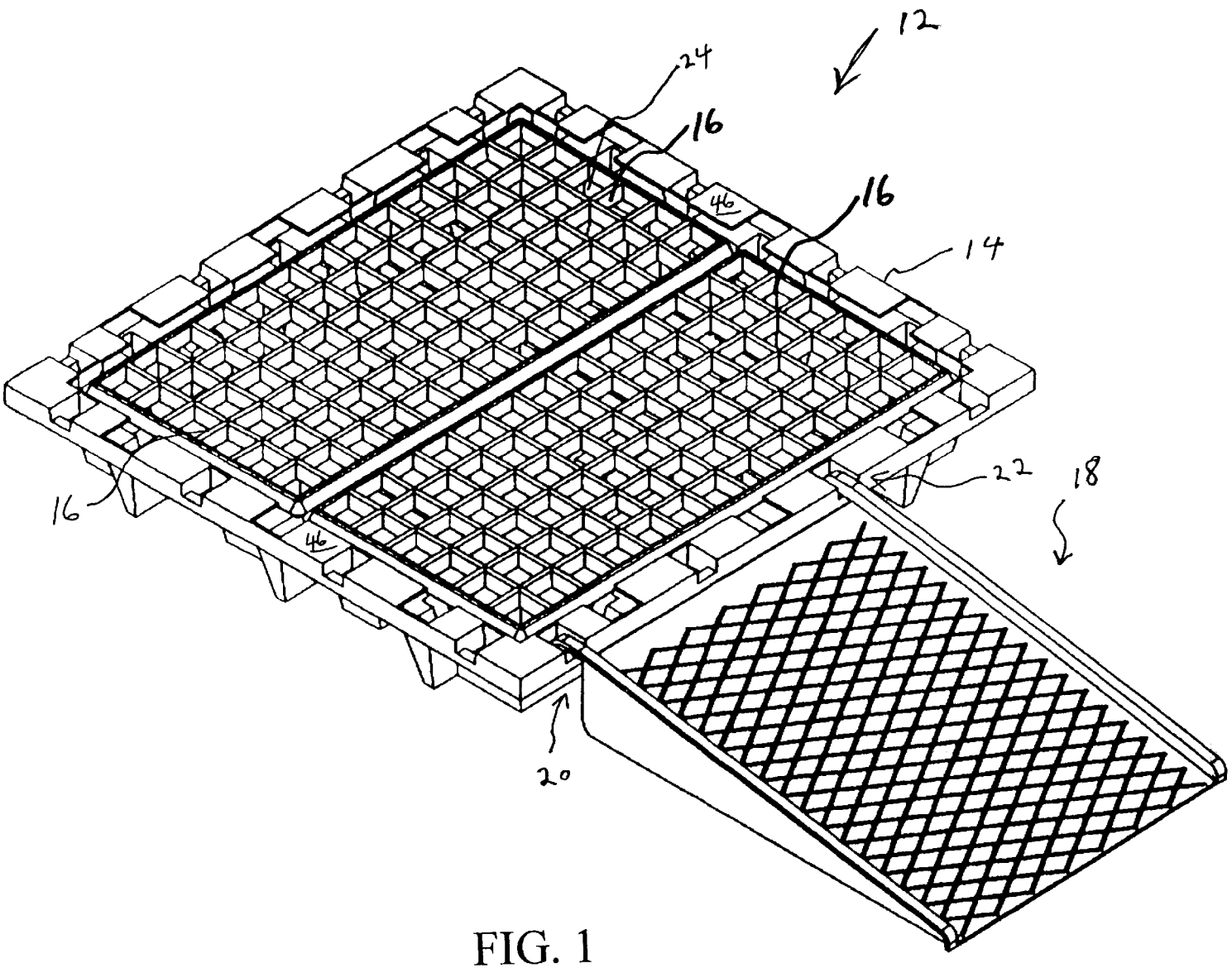
FIG. 1 is a top perspective view of a spill pallet including a containment tray of the invention, with a drum support grate in place on the containment tray and a ramp engaged on one side of the pallet.
Figure 2:
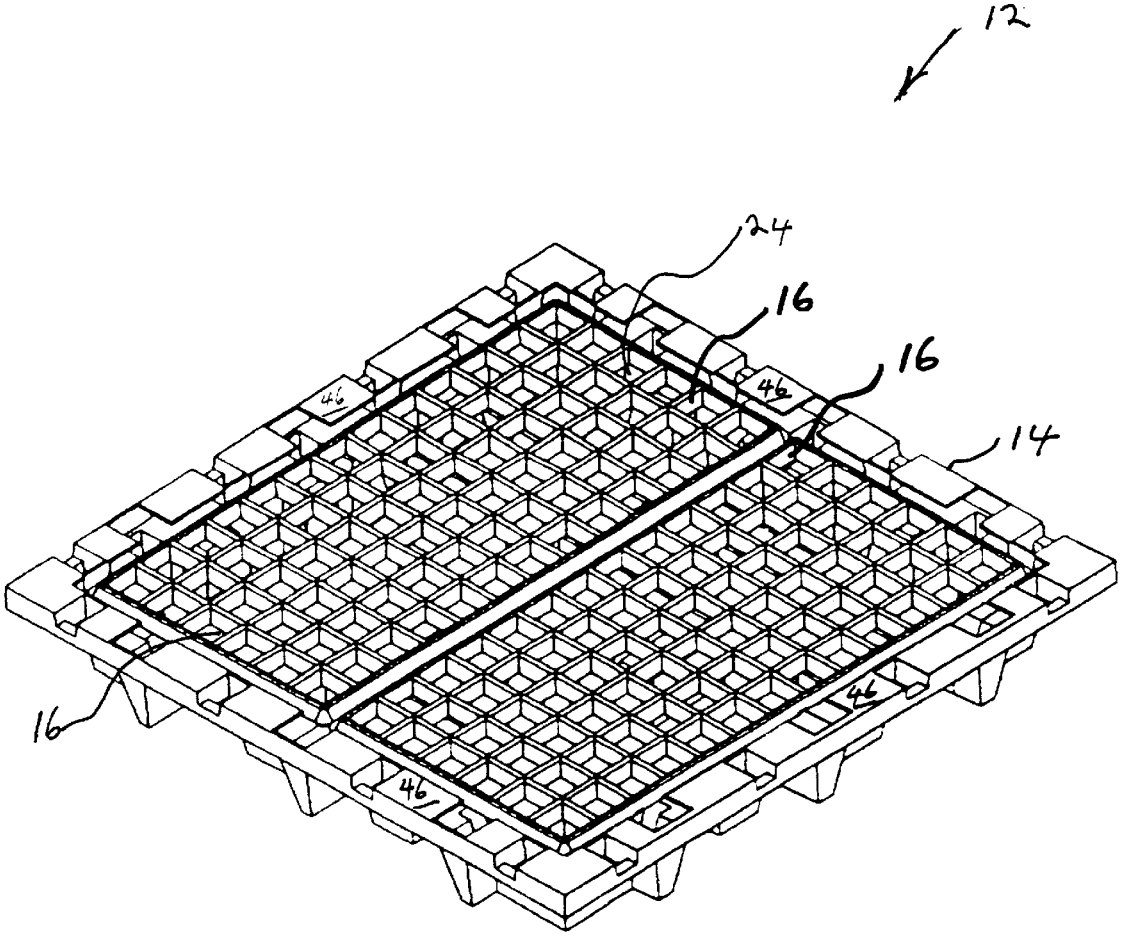
FIG. 2 is a top perspective view of the spill pallet of FIG. 1 without the ramp in place.
Figure 3:
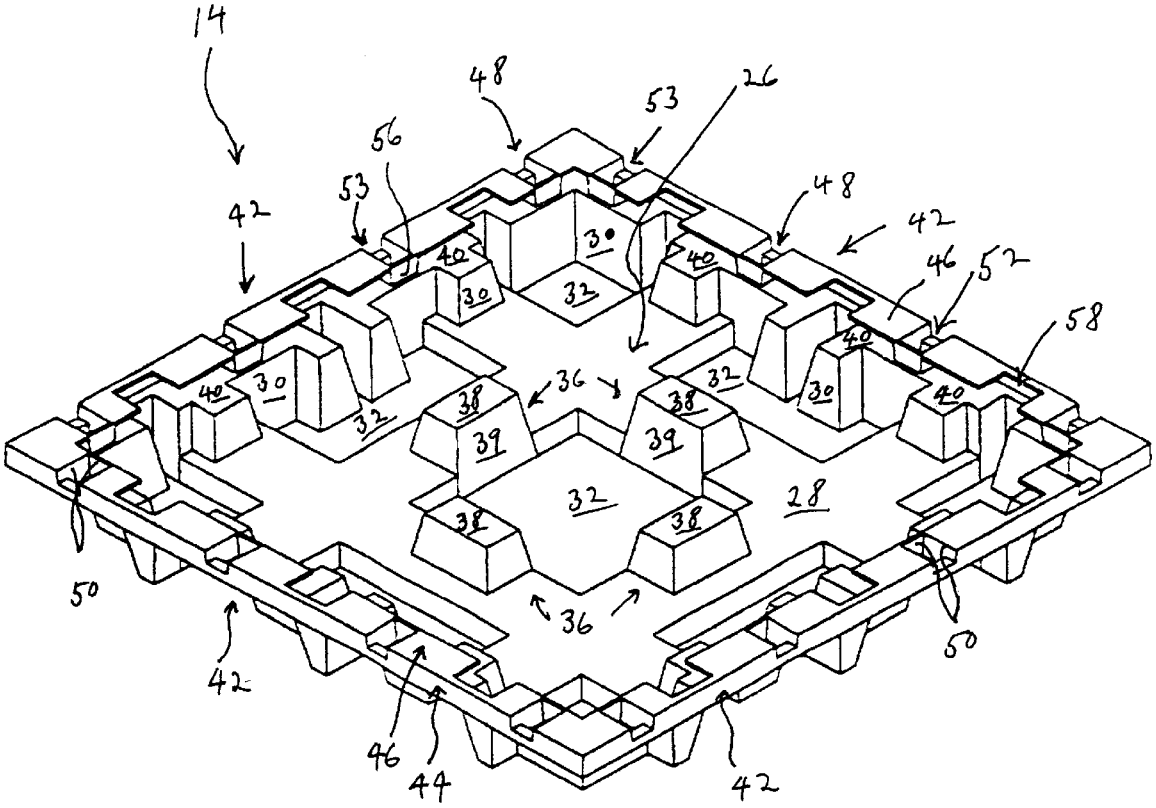
FIG. 3 is a top perspective view of the containment tray of the invention with the drum support grate removed so as to reveal details of the containment tray.

The present invention is to a containment tray for use in a hazardous material spill pallet. FIG. 1 shows spill pallet 12 which is made up of containment tray 14 and support grates 16. Grates such as those described in U.S. Pat. No. 5,375,537 can be used with the present invention. An auxiliary device, ramp 18, is attached to the spill pallet at 20 and 22. FIG. 2 shows the spill pallet with the ramp removed. A plurality of drums containing hazardous material (not shown) are supported on the horizontally oriented support surface of grate 16 when in use. In the event of leakage of hazardous material from a drum or spillage during use of the hazardous material from a drum, the material, typically in liquid form, drains through the many apertures 24 of the grate and into the containment tray 14. FIG. 3 shows the containment tray 14 without the support grates in place, so as to expose a containment chamber 26 into which the hazardous material flows. The capacity of the containment chamber is in accordance with current EPA requirements.

The containment tray of the invention is preferably fabricated by rotational molding, however other methods of molding such as blow molding are available. The preferred material of the tray is polyethylene although other thermoplastic materials, can be used. The thickness of the molded material is between about 0.2 and 0.25 inches.

Containment tray 14 has a bottom wall 28, and side walls 30 which extend generally upwardly from the periphery of the bottom wall, so as to form an open-top fluid receiving and retaining chamber. Walls 30, which extend in various horizontal directions, extend completely around the periphery of bottom wall 28. For purposes of this disclosure, a generally rectangular four drum spill pallet is described, however features of the invention are applicable to spill pallets of other dimensions. A preferred embodiment of the invention is a generally square shaped pallet which is symmetric about its center. Side walls 30 extend upwardly and slightly outwardly at an angle of from 10° to 15° from perpendicular to the bottom wall. The slight outward angle enables nesting of one tray within another. Nesting permits a large number of trays to be placed in a stacked condition for storage or shipping thus conserving valuable space and reducing shipping expenses. In the preferred embodiment, that is with symmetry about its center, the trays are nestable without regard for alignment of a particular edge of each tray.

At selected portions of the bottom wall, bottom wall recesses 32 are formed which define external facing open channels 34 (FIG. 4) for insertion of pallet lifting means. Channels 34 are best viewed in FIG. 4 which is a bottom perspective view of the containment tray. The channels provide access from all four sides of the spill pallet for lifting means which most commonly consist of tines of a fork lift.

Projecting from the bottom wall, at locations offset from the center portion of the containment tray, are a plurality of support posts 36, for at least partially supporting grate 16, when in place. The support posts are positioned intermediate the tray center and the side walls 30. Each post includes a grate support surface 38 which lies in a grate support plane defined by surfaces 38. Side walls of support posts 36, like side walls 30 extending from bottom wall 28, are inclined at about 10°–15° from perpendicular to the bottom wall so as to enable nesting as discussed above. One of the side walls, 39, of each support post 36 extends from grate support surface 38 downwardly to a bottom wall recessed portion 32. With such a configuration, the load on the support post is at least partially bearing on the bottom wall recess, which is more solidly supported from beneath the spill pallet than the remaining bottom wall (non-recessed) of the tray from which the remaining three side walls of the support post extend.

The periphery of the grate 16 is supported by ledge 40, which extends outwardly from top edges of the side walls 30 and lies in the grate support plane. The combined support provided by the support posts and ledge give ample support to the grate when installed and loaded with drums of hazardous material. The absence of additional support members adds to the volume of the retaining chamber so as to achieve the required volume yet present a spill pallet of a relatively low profile in relation to other spill pallets known in the art. A large portion of side wall 30, which extends upwardly and supports ledge 40, extends from bottom wall recessed portions 32 so as to provide a more solid ledge in light of the solid support from beneath the spill pallet as discussed above.

A peripheral L-shaped flange 42 extends upwardly and inwardly from an outer periphery of ledge 40. The flange has a substantially vertically oriented face 44 and a substantially horizontally oriented face 46. In a preferred embodiment of the spill pallet, a plane defined by horizontally oriented face 46 coincides with the top supporting surface of grate 16 when disposed on the spill pallet. Having the entire horizontal surface of the spill pallet (face 46 of flange 42 and top surface of grate 16) in a single plane facilitates use of the pallet, especially when drums are placed or removed from the pallet with means such as a drum dolly or the like.

To add vertical support to flange face 46, a plurality of flange supports 48 are formed by walls 50 which extend between ledge 40 and flange face 46. In the preferred embodiment, three walls are present for each flange support and 16 flange supports are provided in the tray. The flange supports are particularly useful for adding vertical strength to flange face 46, which is needed if a drum is partially supported by the ledge 40 or more importantly for added strength needed when the trays are nested to form a tall stack of trays for storage or shipping purposes.

In addition to the three walls extending from ledge 40 to flange face 46, a fourth wall 52, L-shaped in configuration, extends upwardly from ledge 40 and then outwardly toward vertical face 44. The upwardly extending portion does not extend all the way upward to horizontal face 46, but turns to extend outwardly, short of face 46, so as to create an inwardly directed channel 53 at each flange support. That channel, 53, provides a location for attaching attachment means of ramp 18 to the spill pallet (see FIG. 1). In the preferred embodiment, the flange supports are generally square in shape and are open at the top and bottom, as best seen in FIGS. 3 and 4 as indicated at 48 and 54 respectively.

The flange supports 48, function also to provide a centering means for grates 16. One of the walls forming the flange support, that is the wall facing toward the grates, for example wall 56 in FIG. 3, bears against edges of a grate 16 so as to maintain it centered on the spill pallet. Without that centering means the grate could slide under the horizontally oriented face 46 of the L-shaped flange 42.

Figure 4:
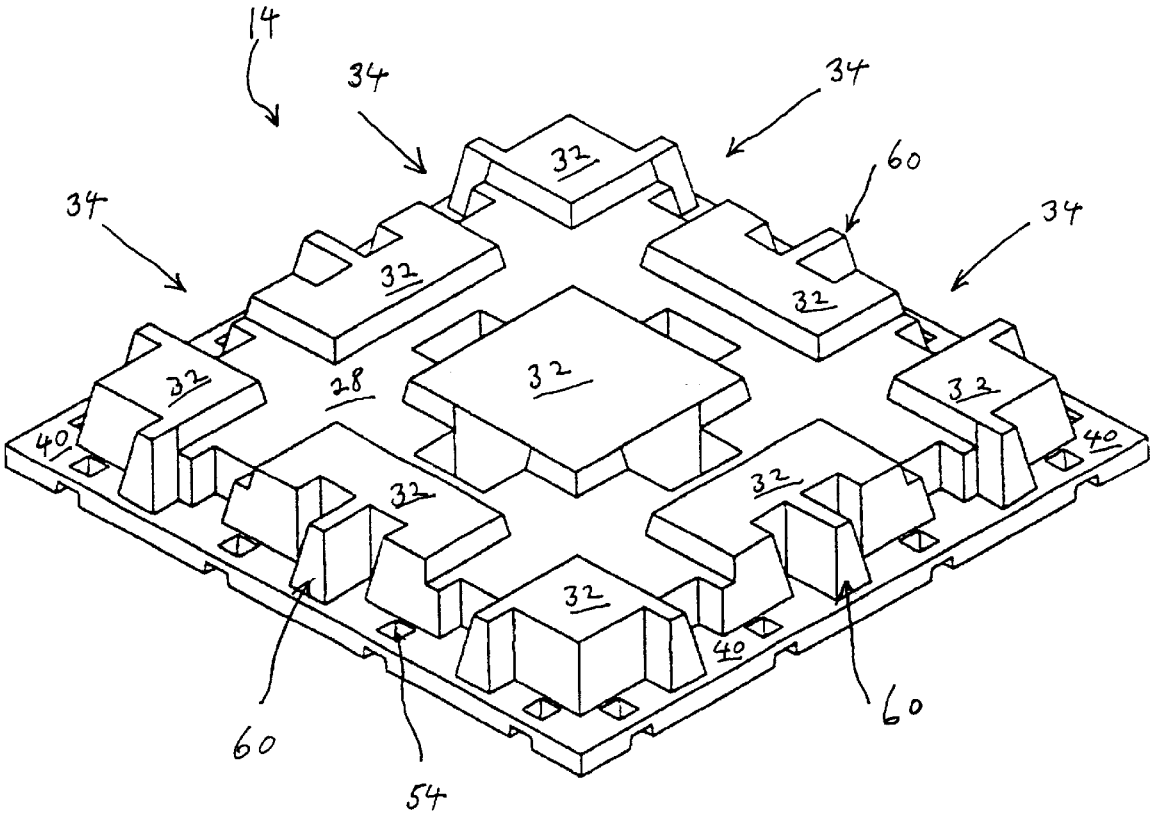
FIG. 4 is a bottom perspective view of the containment tray of the invention.

In order to provide vertical support between the surface on which the spill pallet is placed and ledge 40, and in turn to the horizontally oriented face 46 of L-shaped flange 42, the side wall 30, which extends in various horizontal directions, is routed, as best viewed in FIG. 4, to form support ribs 60. At those rib locations, the side wall is extended out almost to the outer edge of ledge 40 to provide adequate vertical support to the ledge. In the preferred embodiment, three support ribs are provided per side of the containment tray. The walls of the support ribs extend from portions of the bottom wall in which bottom wall recesses are positioned so as to have more solid bearing, as discussed above.

In order to enable nesting of the containment trays the horizontally oriented face 46 of the L-shaped flange 42 has periodic gaps, such as at 58 in FIG. 3, to accommodate the support ribs 60 of an adjacent nested containment tray.

While specific materials, methods of fabricating and configurations have been set forth for purposes of describing an embodiment of the invention, various modifications can be resorted to, in light of the above teachings, without departing from applicant's novel contributions; therefore in determining the scope of the present invention, reference shall be made to the appended claims.

What is claimed is:

1. A containment tray for a hazardous material spill pallet for storage of drums containing hazardous material supported on a removable grate, said containment tray comprising a bottom wall;

side walls extending upwardly from the periphery of said bottom wall to form an open-top fluid-receiving chamber;

a plurality of bottom wall recesses in said bottom wall defining external facing open channels for insertion of pallet lifting means;

a plurality of support posts, offset from the center of the tray, extending upwardly from said bottom wall, having a grate support surface lying in a grate support plane;

a ledge, extending outwardly from top edges of said side walls, lying in the grate support plane;

a peripheral L-shaped flange extending upwardly then inwardly from an outer periphery of said ledge, said L-shaped flange having a substantially vertically oriented and a substantially horizontally oriented face; and a plurality of flange supports formed by walls extending between said ledge and the horizontally oriented face of said L-shaped flange.

2. A containment tray according to claim 1, wherein said side walls, said recesses, and said support posts are configured so as to enable nesting of one containment tray in another containment tray.

3. A containment tray according to claim 1, wherein the shape of the containment tray is generally rectangular, and said open channnels are provided for entry of pallet lifting means from four sides of the containment tray.

4. A containment tray according to claim, wherein each said flange support is square shaped and partially formed by three walls extending between said ledge and the horizontally oriented face of said L-shaped flange so as to strengthen said horizontally oriented face.

5. A containment tray according to claim 4, wherein each said flange support is open at its top and bottom.

6. A containment tray according to claim 5, further comprising an L-shaped wall, forming a part of each said flange support, extending upwardly from said ledge then outwardly to the vertically oriented face to said L-shaped flange.

7. A containment tray according to claim 6, wherein said L-shaped wall is configured to provide a channel at each flange support for accepting attachment means of auxiliary devices.

8. A containment tray according to claim 4, wherein one of the walls of each said flange support provides a centering means for the removable grate when the latter is placed on the grate support surface.

9. A containment tray according to claim 1, wherein portions of said side wall extending upwardly from said bottom wall to said ledge are configured to form support ribs for adding wig support to said ledge.

10. A containment tray according to claim 9, wherein said L-shaped flange has gaps in portions thereof, above each said support rib, so as to enable entry of a rib from an adjacent containment tray when in nested arrangement.

11. A containment tray according to claim 9, wherein the portions of the containment tray side walls which are configured to form said support ribs extend downwardly to bottom wall recessed portions.

12. A containment tray according to claim 1, wherein said tray is fabricated of polyethylene.

13. A containment tray according to claim 1, wherein the shape of the containment tray is generally square, and the tray is symmetric about its center so as to facilitate nesting without regard to alignment of a specific edge of each tray.

14. A containment tray according to claim 1, wherein each support post has at least one side wall which extends to a bottom wall recessed portion.

15. A containment tray for a hazardous material spill pallet for storage of drums containing hazardous material supported on a removable grate, said containment tray comprising a bottom wall;

side walls extending upwardly from the periphery of said bottom wall to form an open-top fluid-receiving chamber;

a plurality of bottom wall recesses in said bottom wall defining external facing open channels for insertion of pallet lifting means;

a plurality of support posts, offset from the center of the tray, extending upwardly from said bottom wall, having a grate support surface lying in a grate support plane;

a ledge, extending outwardly from top edges of said side walls, lying in the grate support plane;

a peripheral L-shaped flange extending upwardly then inwardly from an outer periphery of said ledge, said L-shaped flange having a substantially vertically oriented and a substantially horizontally oriented face; and a plurality of flange supports, generally square in shape, formed by walls extending between said ledge and the horizontally oriented face of said L-shaped flange, and an L-shaped wall extending upwardly from said ledge then outwardly to the vertically oriented face of said L-shaped flange; wherein portions of said side wall extending upwardly from said bottom wall to said ledge are configured to form support ribs for adding support to said ledge.

* * * * *